US008287311B2

(12) United States Patent
Lin et al.

(10) Patent No.: US 8,287,311 B2
(45) Date of Patent: Oct. 16, 2012

(54) ELECTRICAL CONNECTOR AND ASSEMBLING METHOD THEREOF

(75) Inventors: Hsien-Chang Lin, Taoyuan (TW); Shao-Kai Chen, Taoyuan (TW); Chih-Fan Wu, Taoyuan (TW)

(73) Assignee: P-Two Industries Inc., Taoyuan (TW)

( * ) Notice: Subject to any disclaimer, the term of this patent is extended or adjusted under 35 U.S.C. 154(b) by 202 days.

(21) Appl. No.: 12/869,691

(22) Filed: Aug. 26, 2010

(65) Prior Publication Data

US 2011/0177717 A1 Jul. 21, 2011

(30) Foreign Application Priority Data

Jan. 15, 2010 (TW) ..... 99101310 A
Mar. 18, 2010 (TW) ..... 99107930 A

(51) Int. Cl.
*H01R 13/648* (2006.01)

(52) U.S. Cl. ..... 439/607.55

(58) Field of Classification Search ..... 439/607.55, 439/607.1, 579, 736; 29/882
See application file for complete search history.

(56) References Cited

U.S. PATENT DOCUMENTS 6,062,896 A * 5/2000 Huang ..... 439/405
6,139,363 A * 10/2000 Ko et al. ..... 439/579
6,705,893 B1 * 3/2004 Ko ..... 439/607.56
6,793,527 B2 * 9/2004 Noro ..... 439/579
7,201,614 B2 * 4/2007 Cheng et al. ..... 439/736
7,311,552 B1 * 12/2007 Ko ..... 439/579
7,601,029 B2 * 10/2009 Horiuchi et al. ..... 439/607.01
7,641,507 B2 * 1/2010 Ko ..... 439/497
7,914,322 B2 * 3/2011 Lin ..... 439/497
8,070,513 B2 * 12/2011 Ko et al. ..... 439/579
8,172,616 B2 * 5/2012 Miyazaki et al. ..... 439/607.55
2004/0043658 A1 * 3/2004 Ko ..... 439/607

* cited by examiner

*Primary Examiner* — Alexander Gilman
(74) *Attorney, Agent, or Firm* — Cheng-Ju Chiang

(57) ABSTRACT

An electrical connector includes a dielectric housing, a plurality of conductive terminals, a fixing strip, a plurality of wires, and an upper shell, the dielectric housing having an upper face and a lower face opposite to the upper face, the upper face being provided with a plurality of terminal slots and recesses, the conductive terminals having a contact portion, a base portion, an engaged portion and received in the corresponding terminal slots, the engaged portion being engaged against the corresponding recesses, the fixing strip being transversally disposed on the upper face of the dielectric housing and across the conductive terminals and the terminal slots for securing the conductive terminals in the terminal slots, the wires respectively connecting with the base portions of the conductive terminals, and an upper shell is assembled on the dielectric housing above the fixing strip.

10 Claims, 16 Drawing Sheets

ELECTRICAL CONNECTOR AND ASSEMBLING METHOD THEREOF

BACKGROUND OF THE INVENTION

1. Field of the Invention

The present invention relates to an electrical connector, and particularly to an electrical connector having an improved structure for conductive terminals thereof to resist a tension force, and a method for assembling the same.

2. Related Art

An electrical connector is a connecting device used to electrically connect with a cable, a printed circuited board and other circuit elements. Therefore, the electrical connector is widely used on various electrical products like laptops, mobile phones or personal digital assistant (PDA) and so on.

Conventional electrical connectors include an insulated housing, conductive terminals accommodated in the insulated housing, wires and metallic casing shielding the insulated housing. Each of the conductive terminals is formed with barbs at left and right sides thereof to be interferentially engaged with the insulated housing, and up and bottom sides of each of the conductive terminals is encompassed by the insulated housing so that the conductive terminals are able to be accommodated securely and not easy to be deformed by outer force such as a tensile force.

However, conventional electrical connectors as mentioned before are usually too thick to keep up with a tendency of thin type oriented design of electrical products today. Hence it is imperative to develop a novel electrical connector and thereby overcome the foregoing drawbacks.

SUMMARY OF THE INVENTION

Accordingly, an object of the present invention is to provide an electrical connector, includes a dielectric housing, a plurality of conductive terminals, a fixing strip, a plurality of wires, and an upper shell, the dielectric housing having an upper face and a lower face opposite to the upper face, the upper face being provided with a plurality of terminal slots and recesses, each of the conductive terminals having a contact portion, a base portion, an engaged portion and received in the corresponding terminal slots, the contact portion arranged at a front part of the dielectric housing, the base portion arranged at a rear part of the dielectric housing, the engaged portion connecting with the base portion and being engaged against the corresponding recess. The fixing strip is transversally disposed on the upper face of the dielectric housing and across the conductive terminals and the terminal slots for securing the conductive terminals in the terminal slots, the wires respectively connecting with the base portions of the conductive terminals, and an upper shell is assembled on the dielectric housing above the fixing strip.

Another object of the present invention is to provide a method for assembling an electrical connector, including: a step of providing a dielectric housing having an upper face and a lower face opposite to the upper face, the upper face being provided with a plurality of terminal slots and recesses; a step of assembling a plurality of conductive terminals in the corresponding terminal slots of the dielectric housing, wherein each of the conductive terminals has a contact portion, a base portion, and an engaged portion, the contact portion being arranged at a front part of the dielectric housing, the base portion being arranged at a rear part of the dielectric housing, the engaged portion connecting with the base portion; a step of bending the engaged portion of the conductive terminals so as to be engaged against the recesses of the dielectric housing; a step of disposing a fixing strip on the upper face of the dielectric housing, wherein the fixing strip is transversally disposed on and across the conductive terminals and the terminal slots in order to secure the conductive terminals in the terminal slots; a step of soldering a plurality of wires to the corresponding base portion of the conductive terminals; and a step of assembling an upper shell on the dielectric housing above the fixing strip.

Accordingly, the electrical connector of the present invention is characterized in that each of the conductive terminals is provided with the embedded portion and engaged portion, the engaged portion is engaged against a corresponding recess formed on the rear part of a dielectric housing, and the embedded portion is embedded against the fixing strip disposing on the dielectric housing by melting method, thereby the conductive terminals are firmly retained in the dielectric housing. In comparison with conventional electrical connectors, an upper side and a lower side of the conductive terminals of the present invention do not have to be surrounded by the dielectric housing and therefore thickness of the electrical connector is reduced. Namely, the electrical connector of the present invention is of a thin-type structure and is novel to conventional electrical connectors to overcome the drawbacks of the conventional electrical connectors.

DESCRIPTION OF THE PREFERRED EMBODIMENTS

Figure 1:
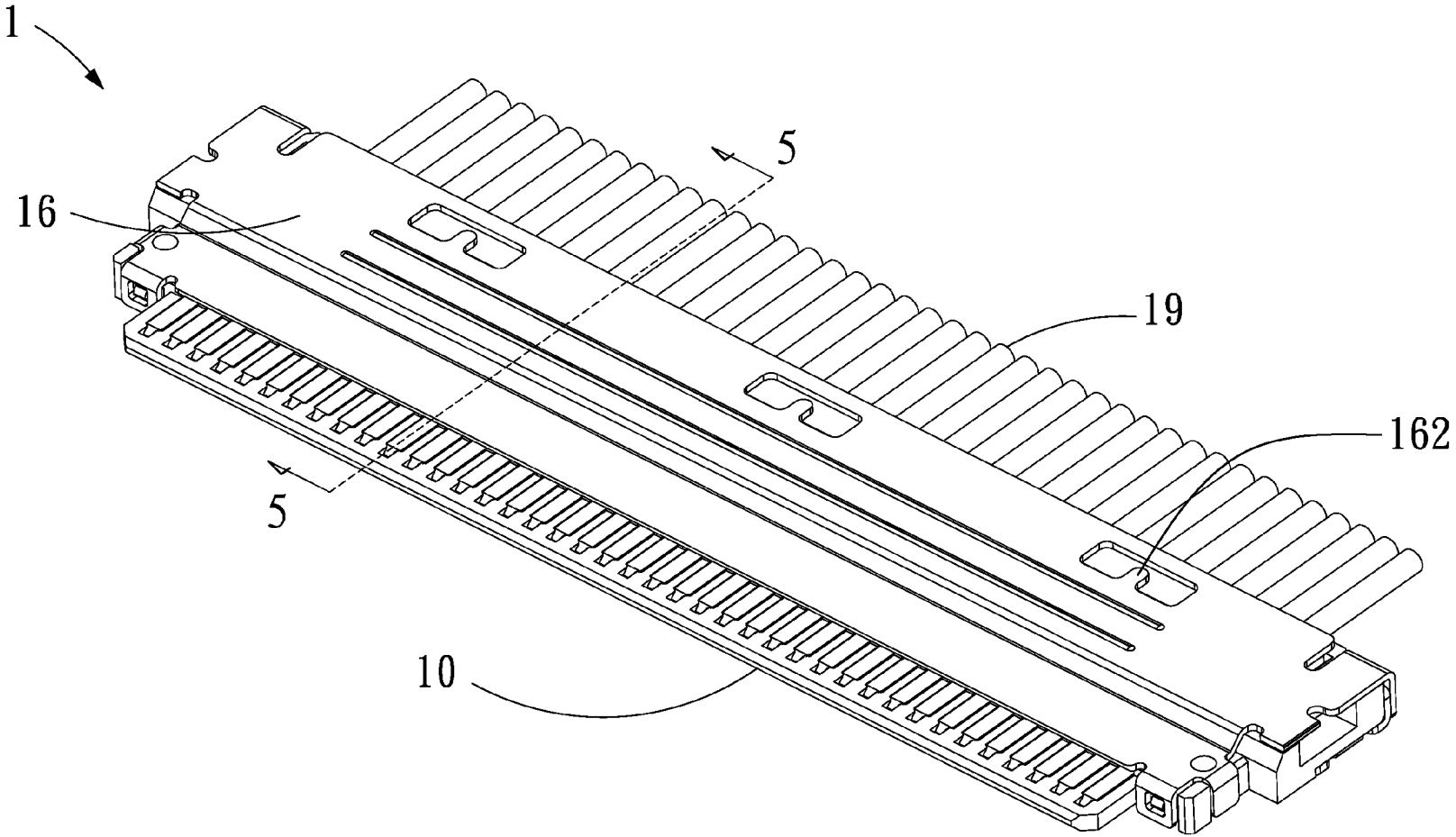
FIG. 1 is a perspective assembly view of an electrical connector of the present invention.
Figure 2:
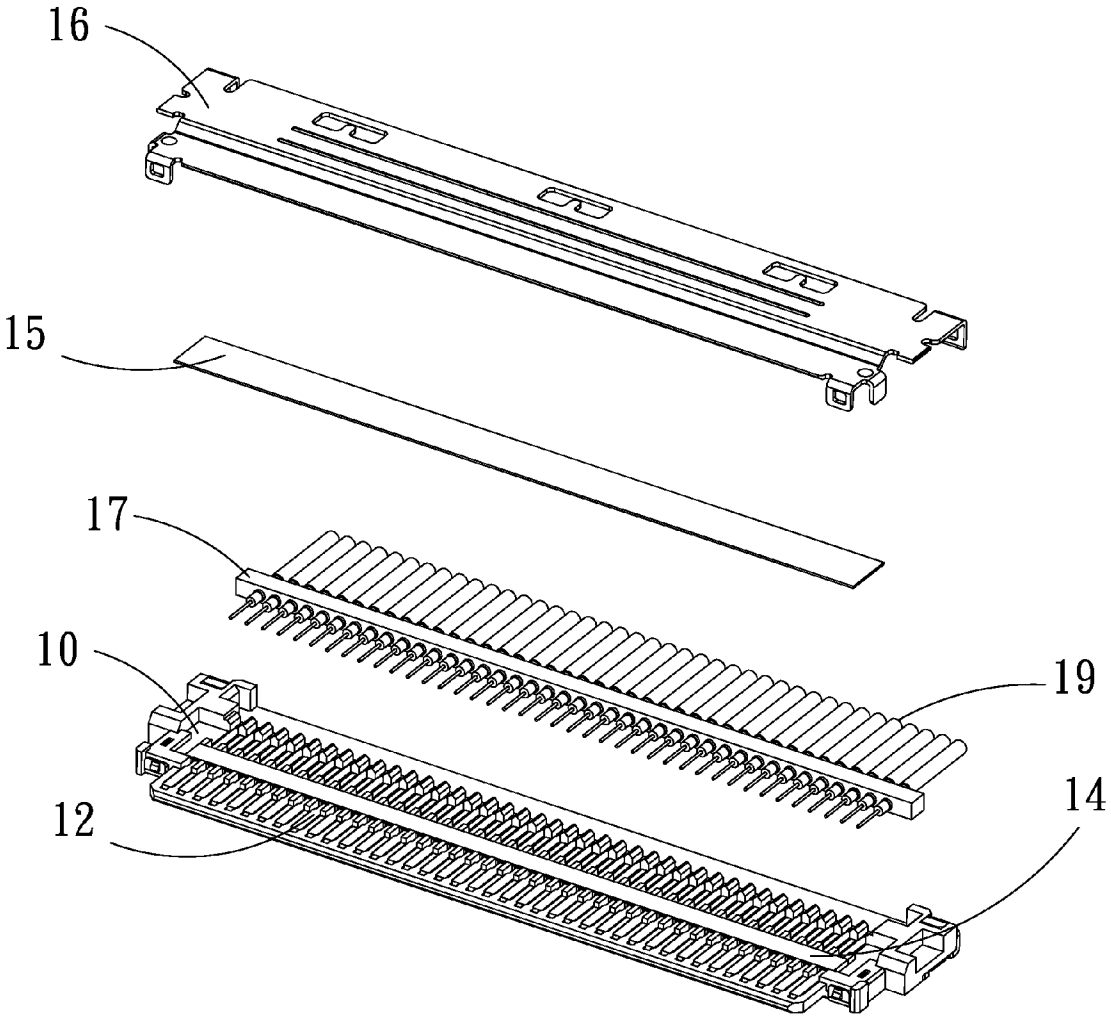
FIG. 2 is a partially exploded view of FIG. 1.
Figure 3:
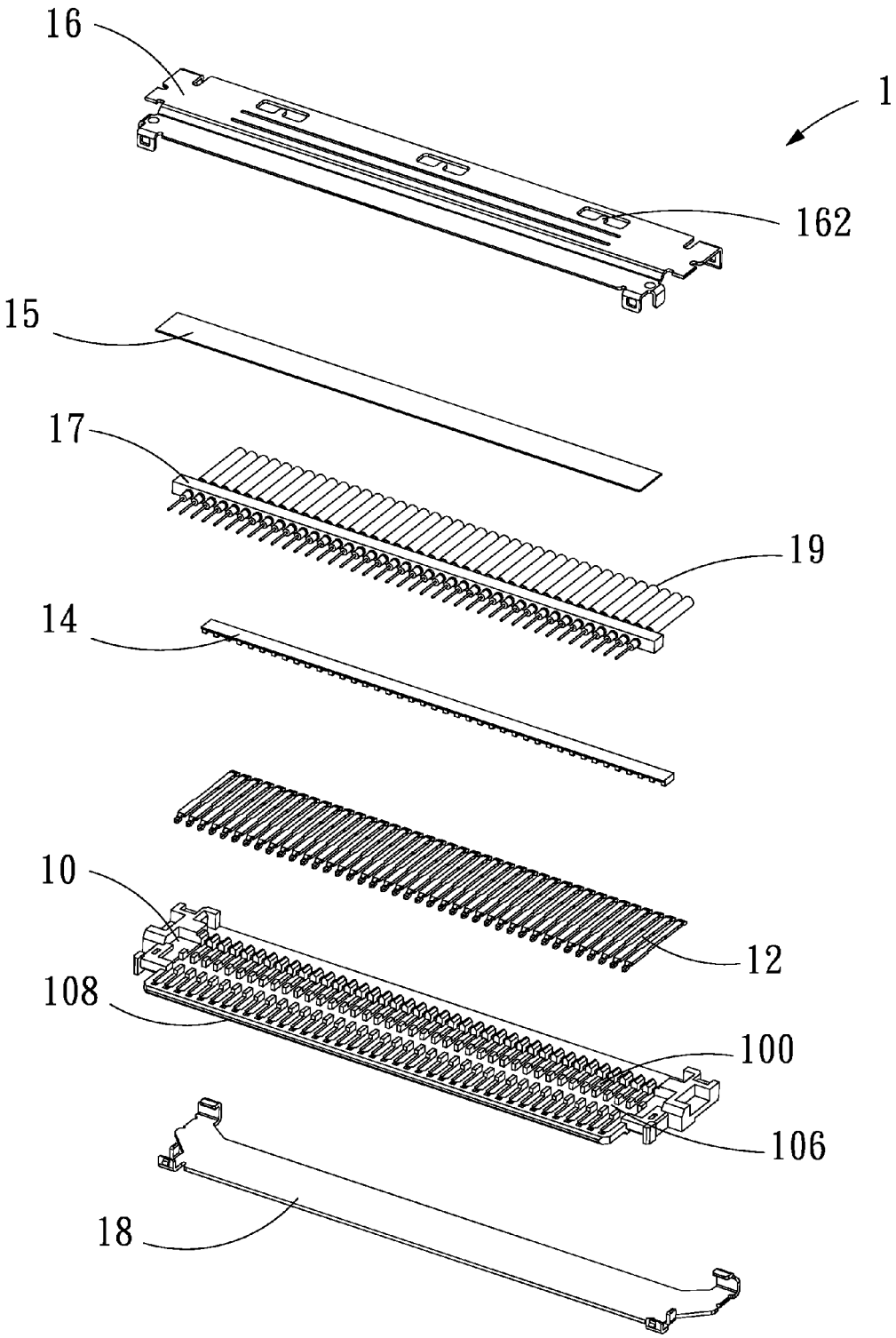
FIG. 3 is an exploded perspective view of FIG. 1.
Figure 4:
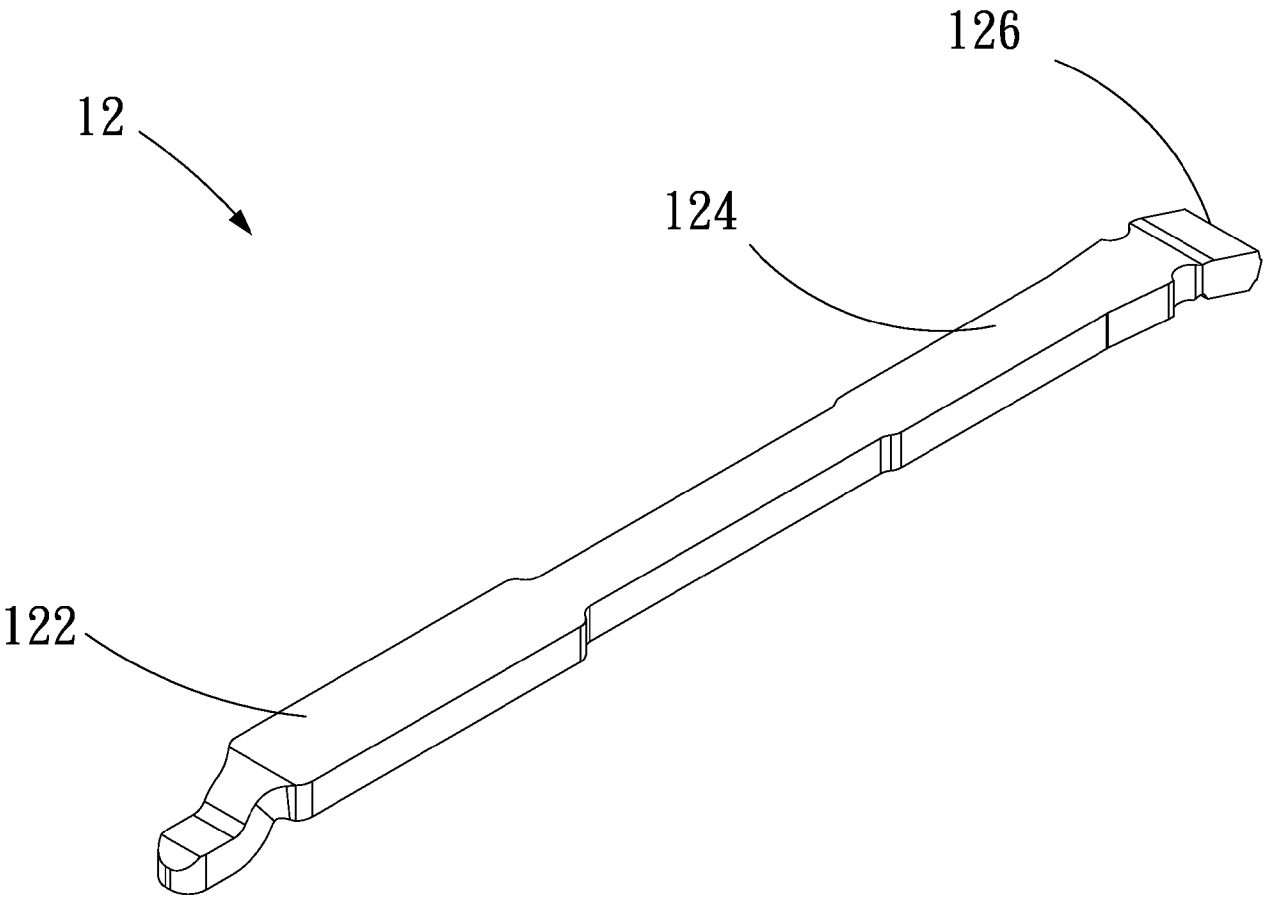
FIG. 4 is a perspective view of a conductive terminal of FIG. 3.
Figure 5:
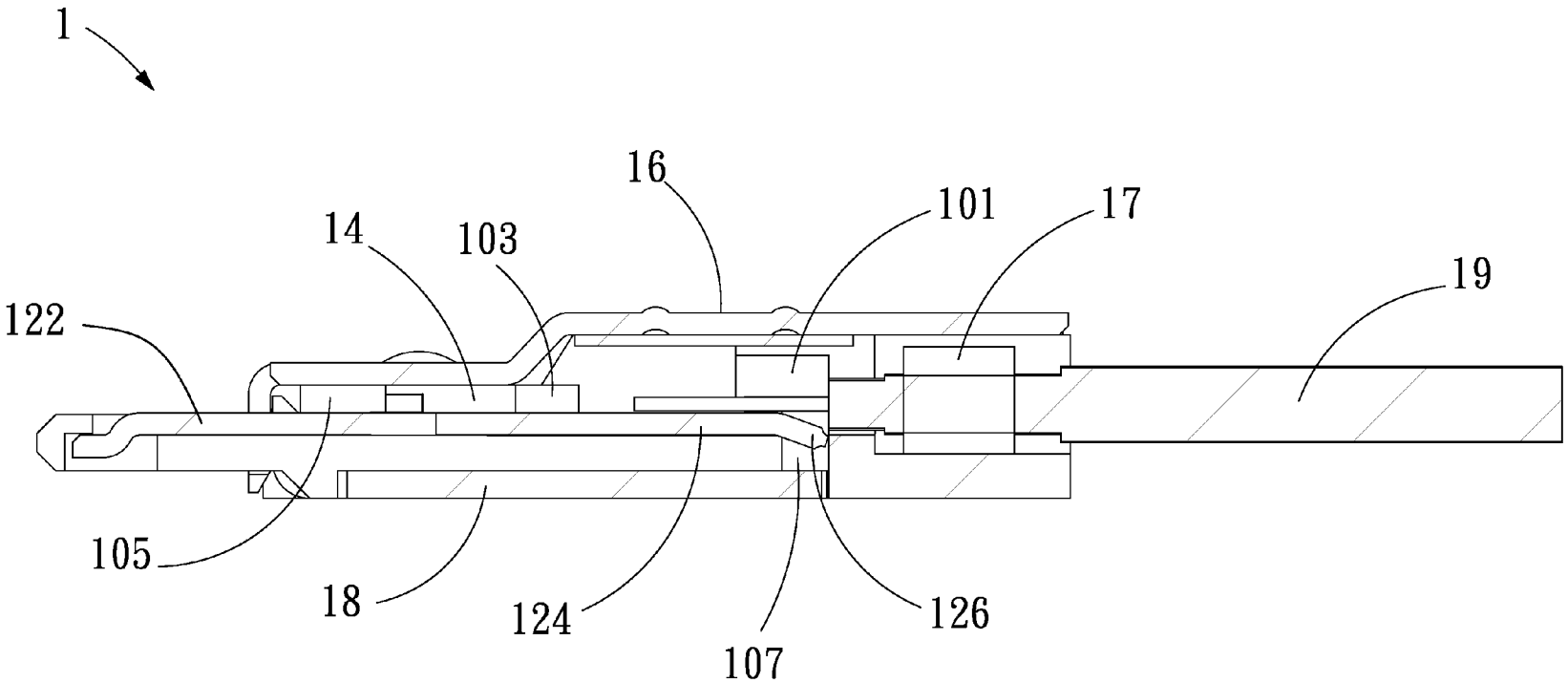
FIG. 5 is a schematic cross-sectional view taken along line 5-5 in FIG. 1.
Figure 6:
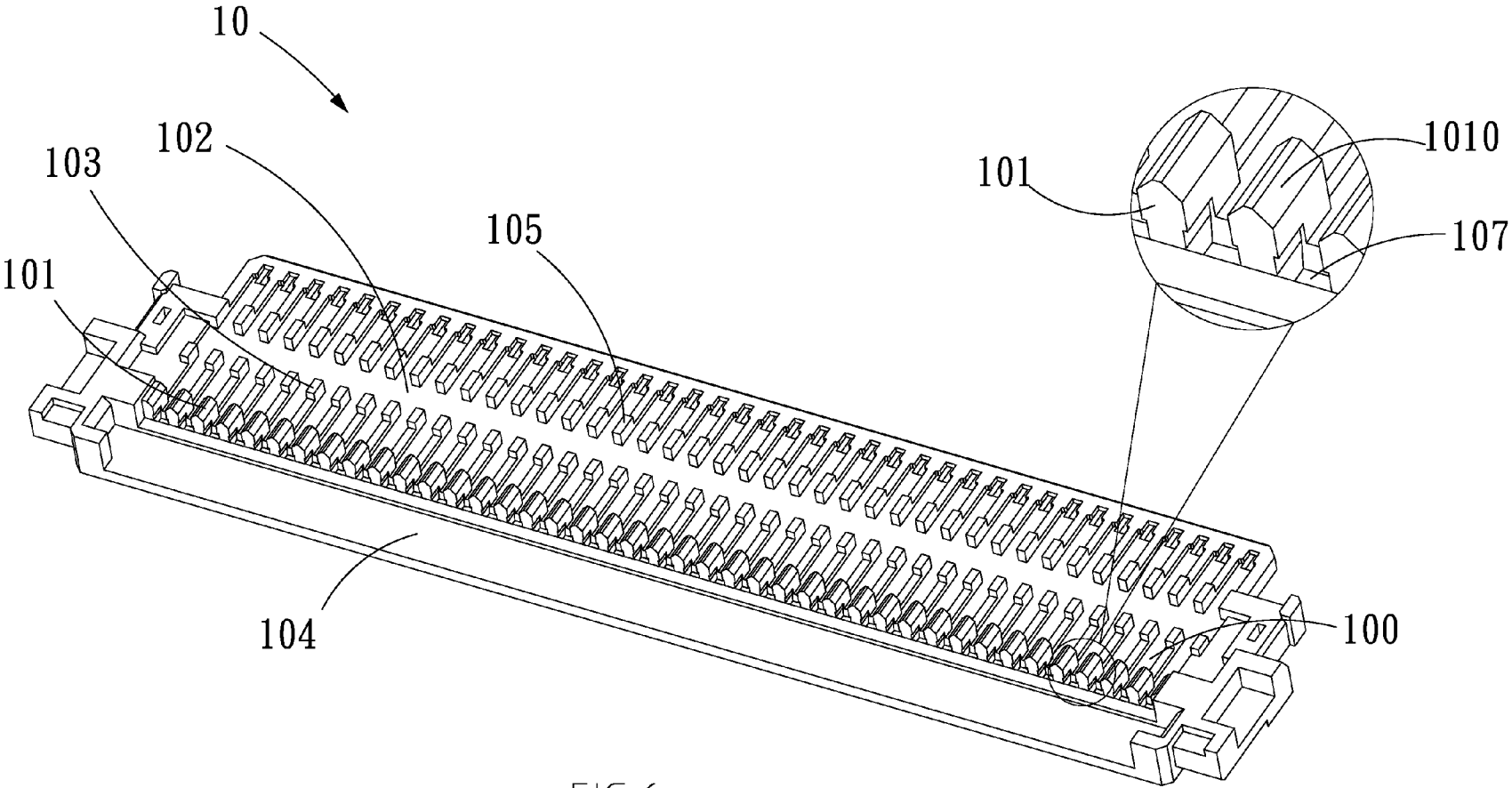
FIG. 6 is a perspective view of a dielectric housing of FIG. 3.

Referring to FIGS. 1 to 6, an electrical connector 1 of the present invention includes a dielectric housing 10, a plurality of conductive terminals 12, a plurality of wires 19, a fixing strip 14, a dielectric slice 15, an upper shell 16 and a lower shell 18, wherein the dielectric housing 10 has an upper face 106 and a lower face 108 opposite to the upper face 106, the upper face 106 is transversally provided with a plurality of terminal slots 100 and recesses 107, and in the present embodiment the dielectric slice 15 is preferably a MYLAR-type dielectric slice used for avoiding a possible short-circuit problem caused by an electrical contact of the upper shell 16 and the wires 19, the upper shell 16 and the lower shell 18 are made of metallic slices and formed by pressing technique.

The conductive terminals 12 are received in the terminal slots 100 on the upper face 106 of the dielectric housing 10, each of the conductive terminals 12 has a contact portion 122, a base portion 124, and an engaged portion 126, the contact portion 122 is arranged at a front part of the dielectric housing 10, the base portion 124 is arranged at a rear part of the dielectric housing 10, the engaged portion 126 connects with the base portion 124 and is engaged against the corresponding recess 107 formed in the rear part of the dielectric housing 10 so as to reinforce engagement of the conductive terminals 12 and the dielectric housing 10. In this embodiment, the conductive terminals 12 are made of metallic slices and formed by pressing technique, wherein the engaged portion 126 is bent downwards by a bending step and is able to be engaged against the corresponding recess 107, the engaged portion 126 extending from the base portion 124 at a rear end of the conductive terminal 12, the base portion 124 further having barbs (not shown) at two lateral opposite sides thereof to interfere with the dielectric housing 10. In this embodiment, the corresponding recess 107 is an opening through the dielectric housing 10.

The fixing strip 14 is transversally disposed on the upper face 106 of the dielectric housing 10 and across the conductive terminals 12 and the terminal slots 100, and particularly, the fixing strip 14 presses against the conductive terminals 12 for securing the conductive terminals 12 in the terminal slots 100 so that the conductive terminals 12 are firmly retained on the upper face 106. In this preferable embodiment, the fixing strip 14 not only secures the conductive terminals 12 but also supports the upper shell 16. The plurality of wires 19 respectively connect with the base portion 124 of the conductive terminals 12, the upper shell 16 is assembled on the dielectric housing 10 above the fixing strip 14, the lower shell 18 is assembled on the dielectric housing 10 opposite to the upper shell 16 and therefore is located below the terminal slots 100, conductive terminals 12 and the wires 19.

In this preferable embodiment, the rear part of the dielectric housing 10 is provided with a plurality of first ribs 101 used for positioning the wires 19 to be in alignment with the corresponding base portion 124 of the conductive terminals 12. One end of the wires 12 is then soldered to the corresponding base portion 124. Furthermore, a top of each of the first ribs 101 is formed with an inclined face 1010 at two opposite sides thereof so that the top is of an inverse V shape which helps the conductive terminals 12 being easily received in the terminal slots 100. Moreover, the front part of the dielectric housing 10 is provided with a plurality of second ribs 103 and third ribs 105, the third ribs 105 are capable of supporting the upper shell 16 and are located in parallel with the second ribs 103, wherein a slit 102 is formed between the second ribs 103 and the third ribs 105. The fixing strip 14 is transversally disposed on the conductive terminals 12 and the terminal slots 100 between the front part and the rear part of the dielectric housing 10 by means of thermocompression processing or ultrasonic vibration processing to fix the conductive terminals 12 on the dielectric housing 10 and is accommodated in the slit 102.

A grounding bar 17 is disposed on the wires 19 and link the wires 19 arranged together. The wires 19 are being grounded with the grounding bar 17. The rear part of the dielectric housing 10 defines a receiving space 104 where the grounding bar 17 is received in. The wires 19 in this embodiment are mini coaxial cables. The upper shell 16 is provided with at least a biasing sheet 162 extending to contact the grounding bar 17, thereby the electrical connector 1 of the present invention is free of electromagnetic wave because the metal upper shell 16 shields the electromagnetic wave, and is grounded by the grounding bar 17.

Figure 7:
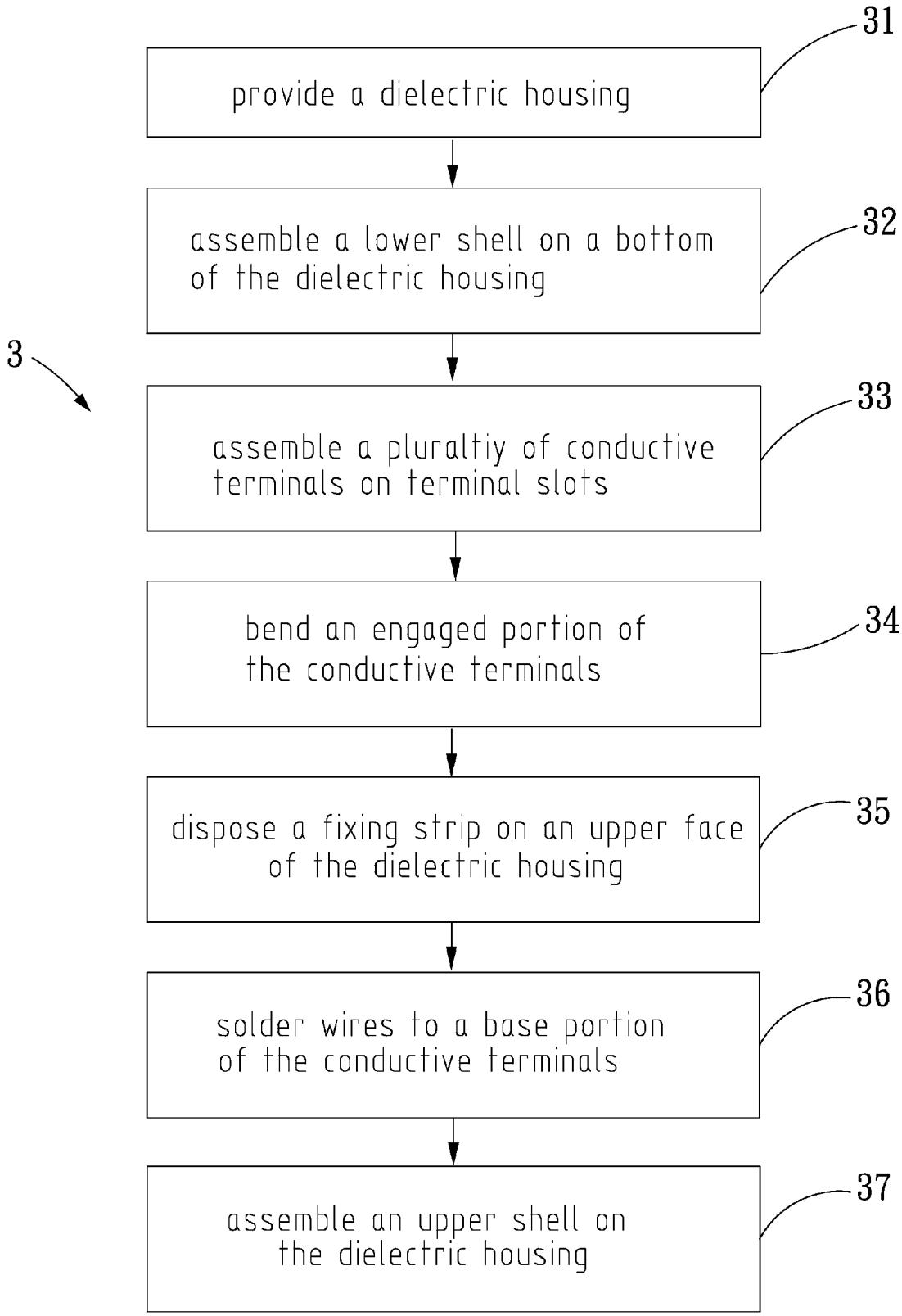
FIG. 7 is a flow diagram showing a method for assembling the electrical connector of the present invention.
Figure 8:
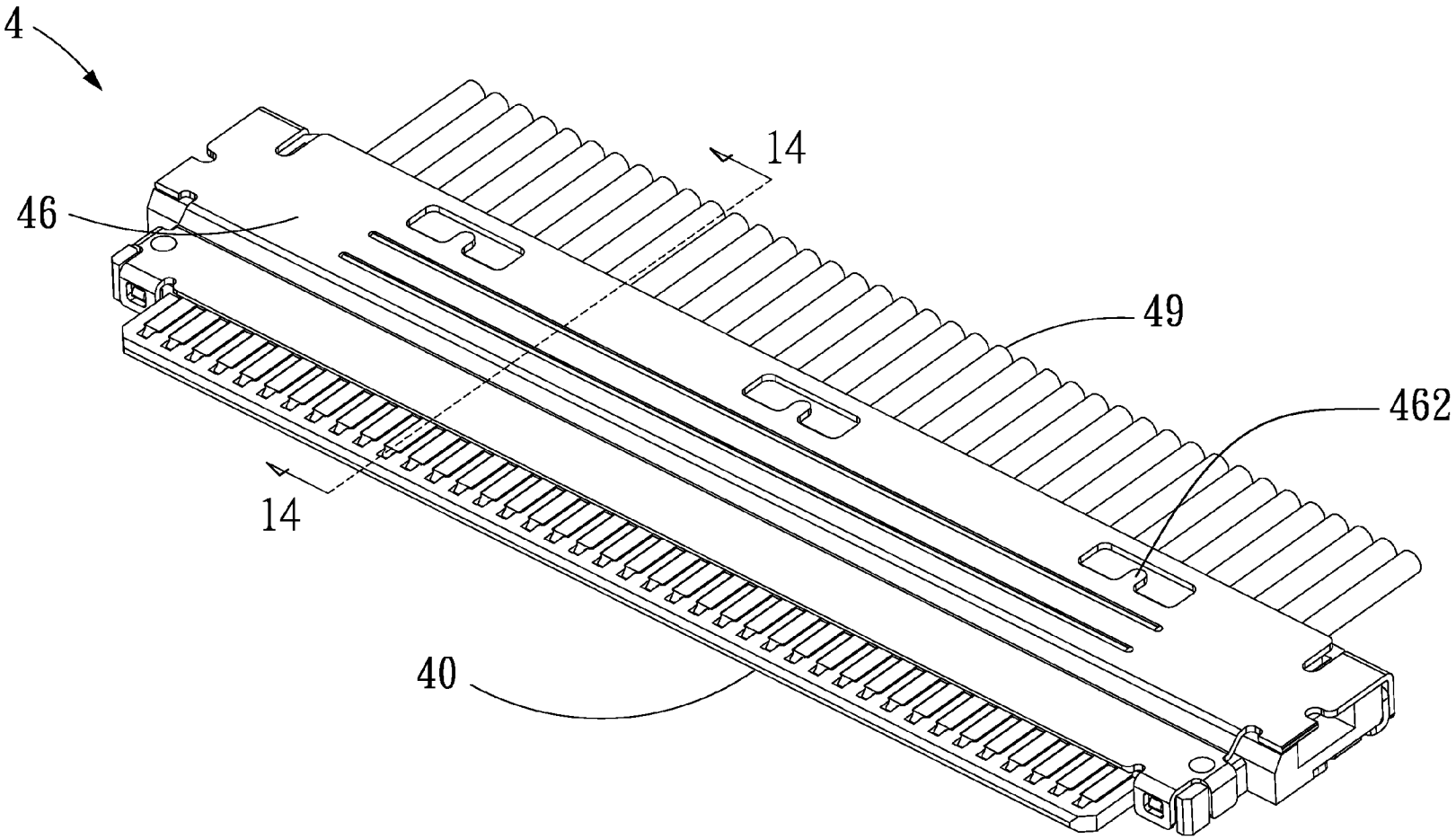
FIG. 8 is another embodiment showing a perspective assembly view of an electrical connector of the present invention.
Figure 9:
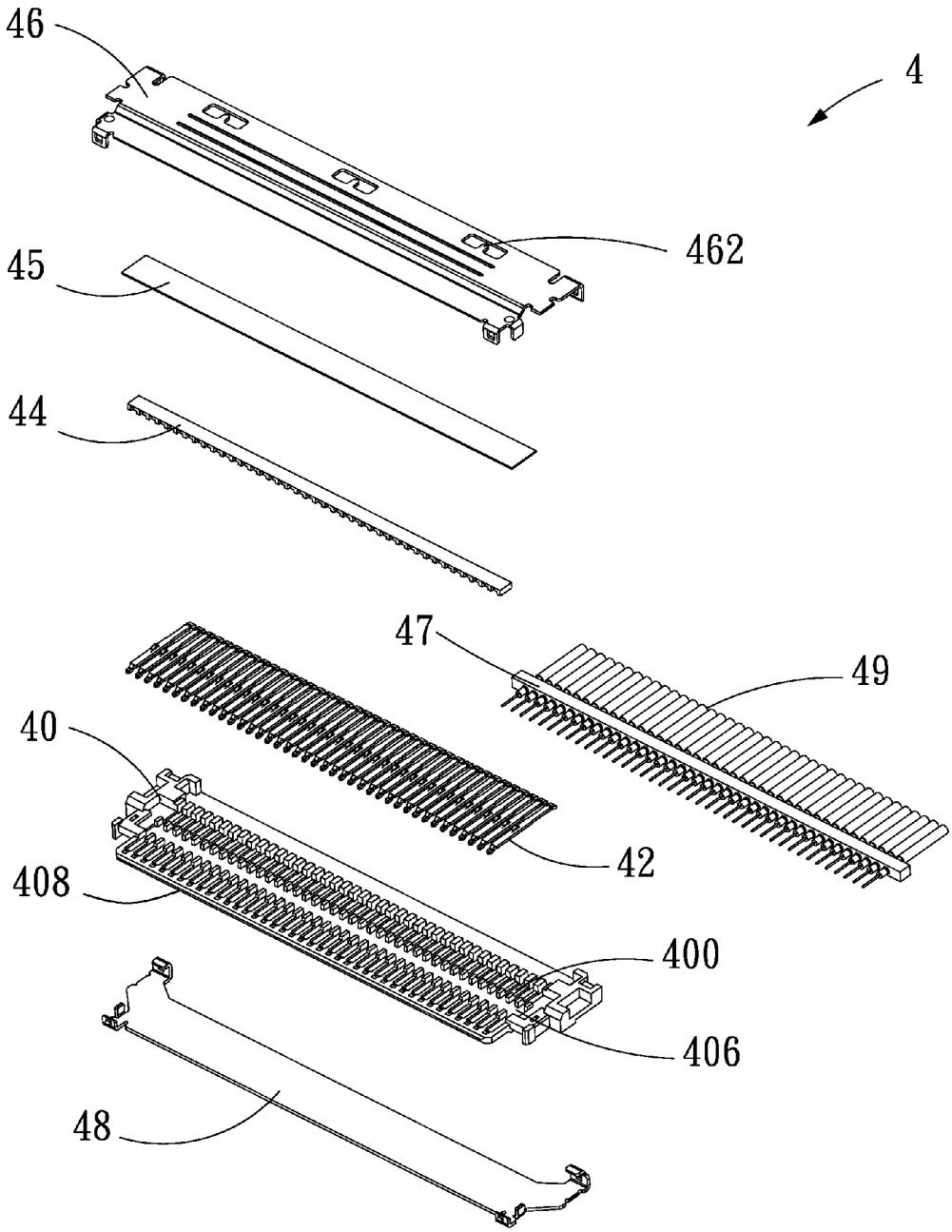
FIG. 9 is an exploded perspective view of FIG. 8.
Figure 10:
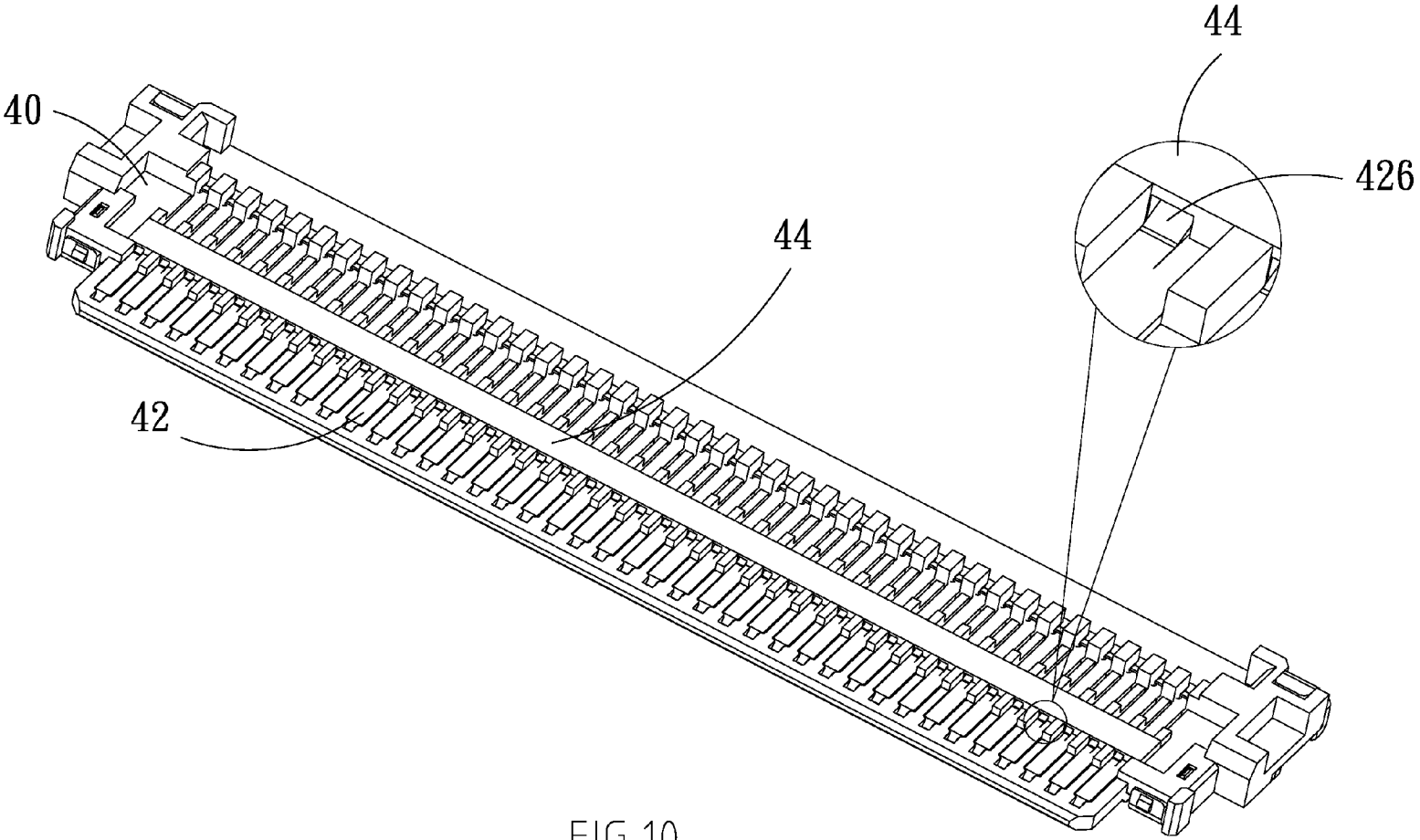
FIG. 10 is a partially perspective assembly view of FIG. 8.
Figure 11:
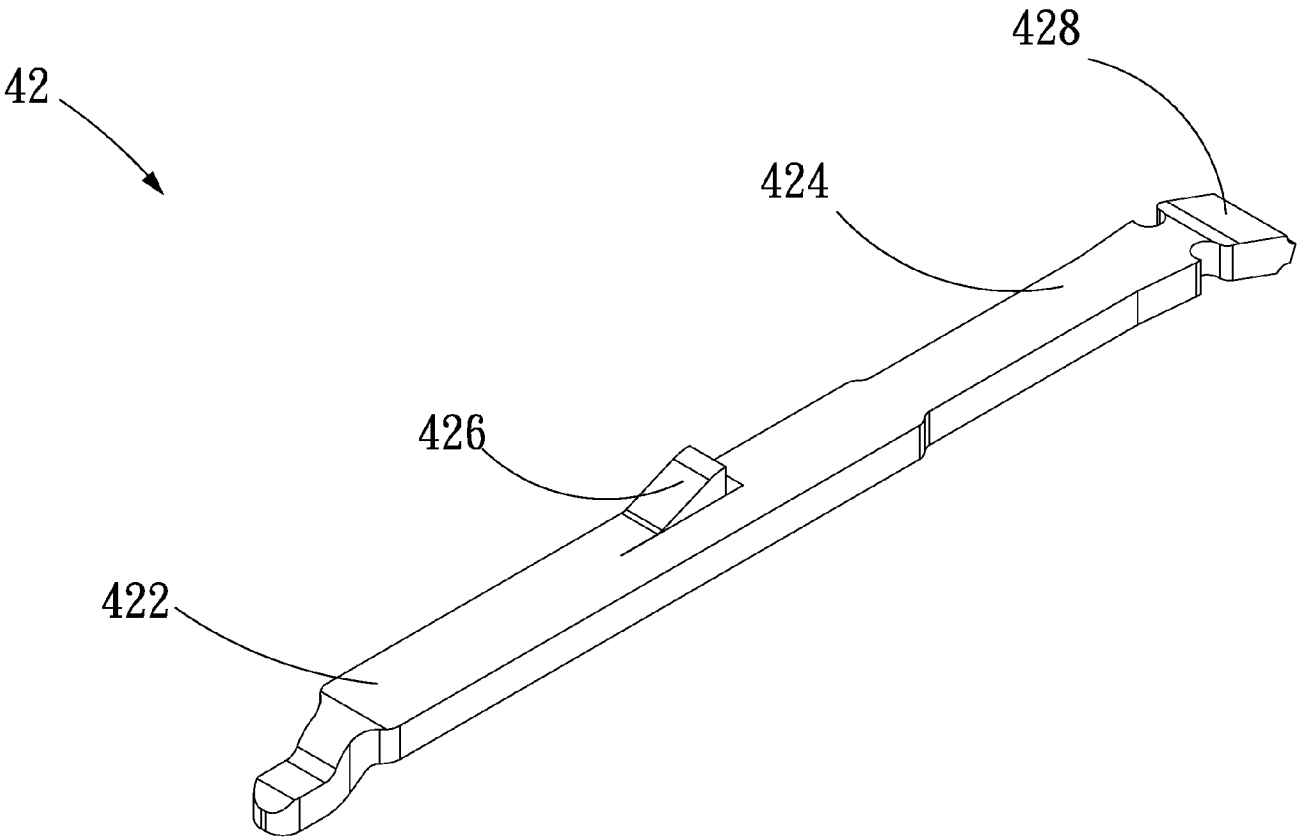
FIG. 11 is a perspective view of a conductive terminal of FIG. 9.
Figure 12:
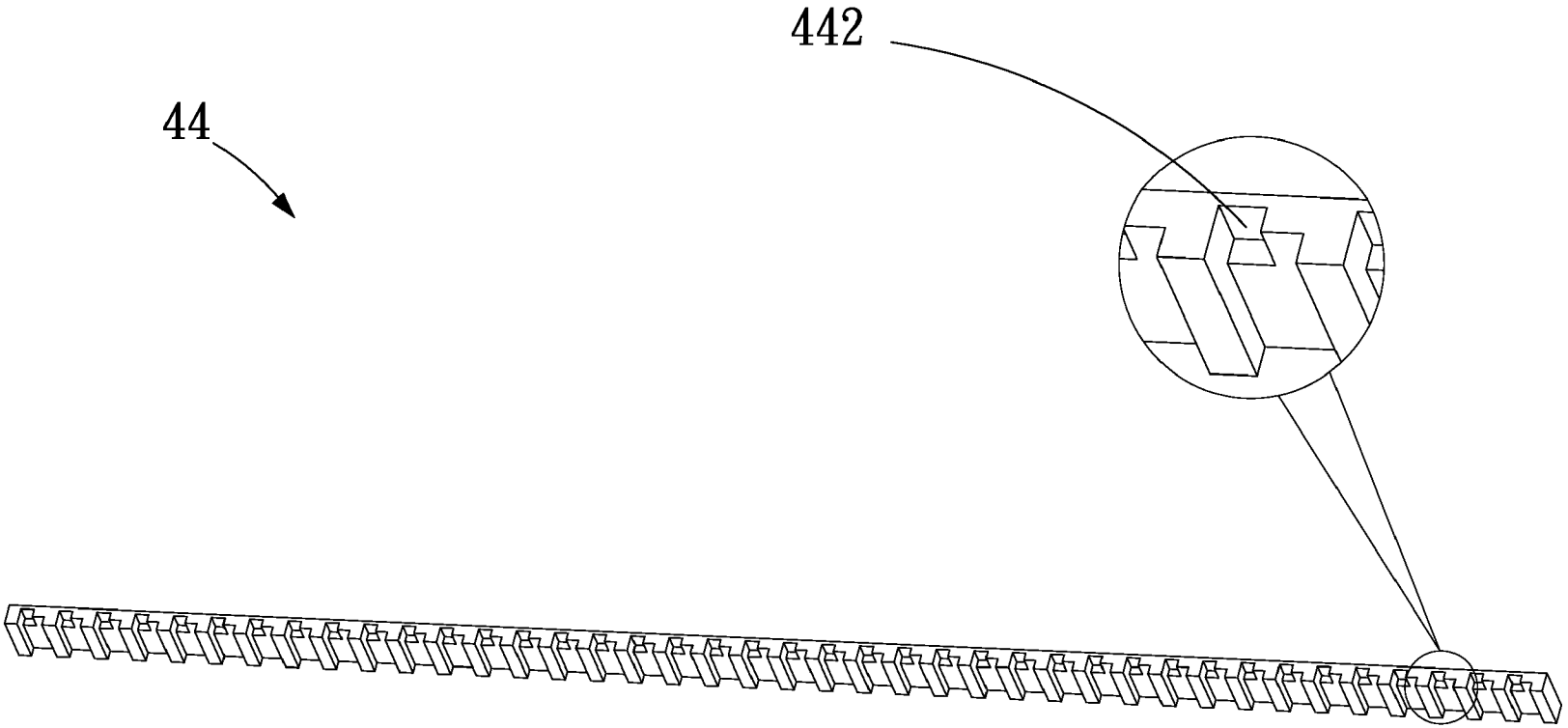
FIG. 12 is a perspective view of a fixing strip of FIG. 9.
Figure 13:
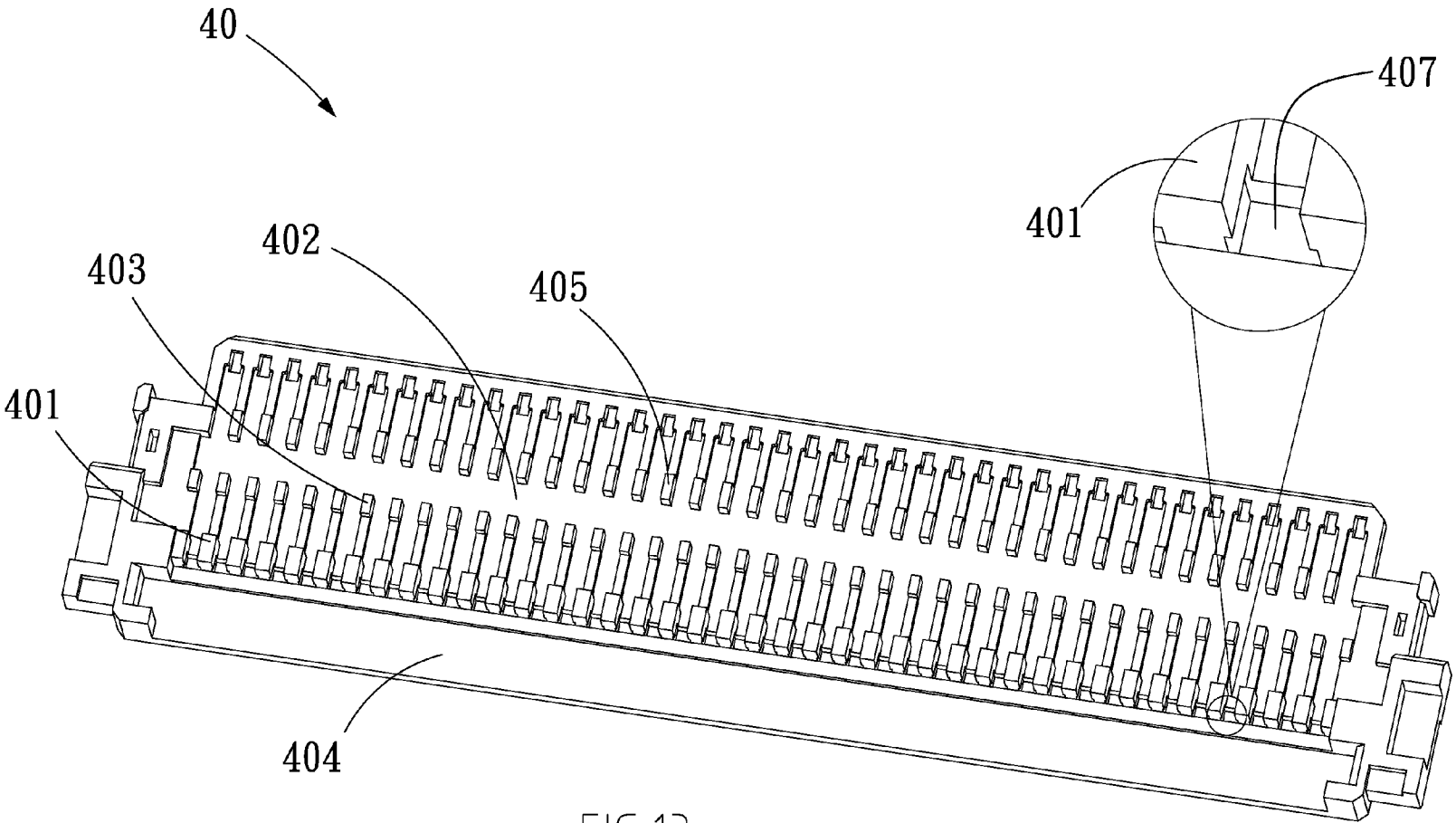
FIG. 13 is a perspective view of a dielectric housing of FIG. 9.
Figure 14:
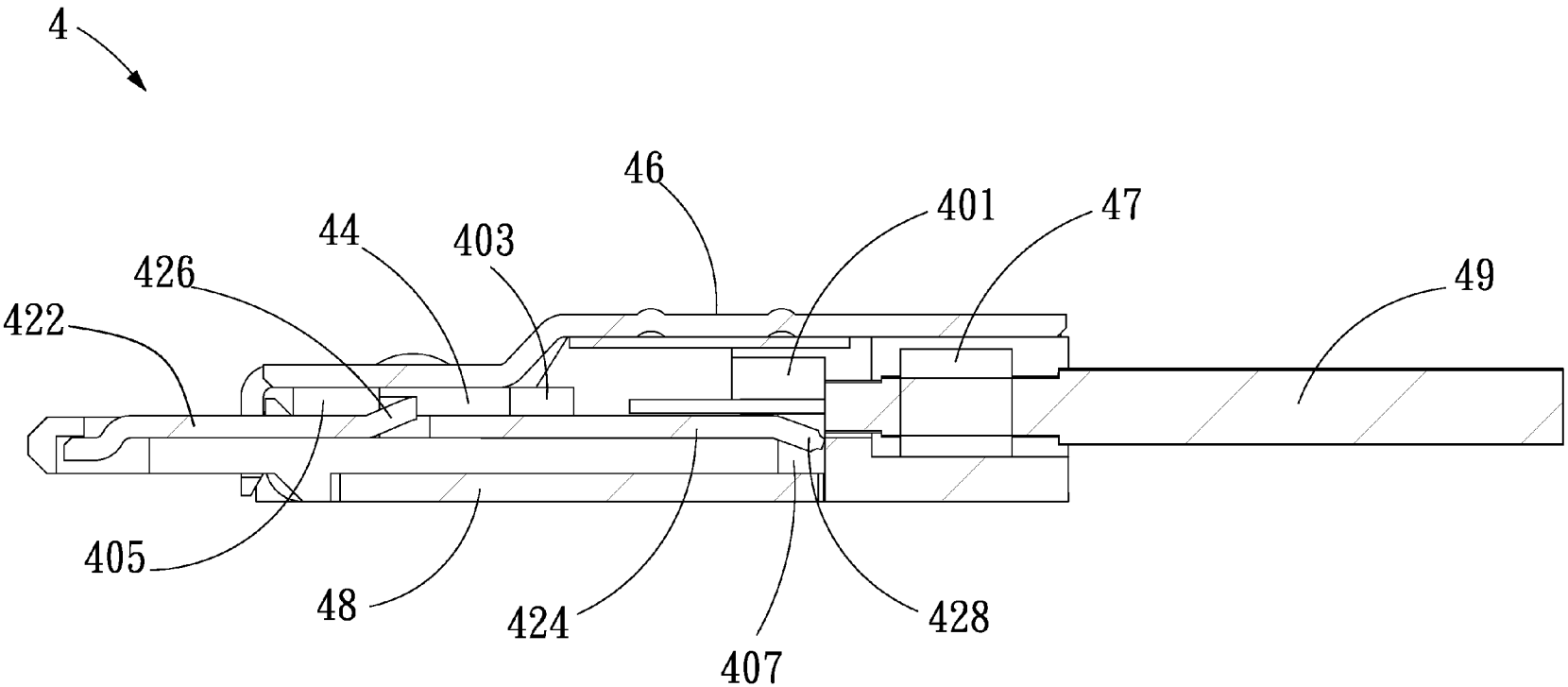
FIG. 14 is a schematic cross-sectional view taken along line 14-14 in FIG. 8.

Please refer to FIG. 7 illustrating a flow diagram of a method 3 of the present invention for assembling an electrical connector. The method 3 includes following steps; first, a step 31 of providing a dielectric housing having an upper face and a lower face opposite to the upper face, the upper face being provided with a plurality of terminal slots and recesses at a rear part of the dielectric housing; a step 32 of assembling a lower shell onto a bottom of the dielectric housing below the terminal slots; a step 33 of assembling a plurality of conductive terminals on the corresponding terminal slots of the dielectric housing, wherein each of the conductive terminals has a contact portion, a base portion, and an engaged portion, the contact portion being arranged at a front part of the dielectric housing, the base portion being arranged at the rear part of the dielectric housing, the engaged portion connecting with the base portion; a step 34 of bending the engaged portion of the conductive terminals so as to be engaged against the recesses at the rear part of the dielectric housing; a step 35 of disposing a fixing strip on the upper face of the dielectric housing, wherein the fixing strip is transversally disposed on and across the conductive terminals and the terminal slots in order to secure the conductive terminals in the terminal slots; then, a step 36 of soldering a plurality of wires to the corresponding base portion of the conductive terminals, and finally a step 37 of assembling an upper shell onto the dielectric housing above the fixing strip. In this embodiment, the fixing strip is assembled on the dielectric housing by thermocompression processing or ultrasonic vibration processing. In particular, the engaged portion is not being bent to be engaged against the recesses of the dielectric housing when the conductive terminals are disposed in the terminal slots. Consequently, the engaged portion is being bent after the conductive terminals are disposed in the terminal slots in order to be perfectly engaged against the recesses.

Please refer to FIGS. 8 to 14 showing another embodiment of an electrical connector 4 of the present invention. The electrical connector 4 includes a dielectric housing 40, a plurality of conductive terminals 42, a plurality of wires 49, a fixing strip 44, a dielectric slice 45, an upper shell 46 and a lower shell 48, wherein the dielectric housing 40 has an upper face 406 and a lower face 408 opposite to the upper face 406, the upper face 406 is transversally provided with a plurality of terminal slots 400 and recesses 407.

The conductive terminals 42 are received in the terminal slots 400 on the upper face 406 of the dielectric housing 40, each of the conductive terminals 42 has a contact portion 422, an embedded portion 426, a base portion 424, and an engaged portion 428, the contact portion 422 is arranged at a front part of the dielectric housing 40, the base portion 424 is arranged at a rear part of the dielectric housing 40, the embedded portion 426 is located between the base portion 424 and the contact portion 422, the engaged portion 428 connects with the base portion 424 and is engaged against the corresponding recess 407 formed in the rear part of the dielectric housing 40. In this embodiment, the conductive terminals 42 are made of metal by pressing technique, wherein the embedded portion 426 protrudes upwards by a tearing step, the engaged portion 428 bends downwards by a bending step and is able to be engaged against the corresponding recess 407, the engaged portion 428 extending from the base portion 424 at a rear end of the conductive terminal 42, the base portion 424 further having barbs (not shown) at two lateral opposite sides thereof to interfere with the dielectric housing 40.

The fixing strip 44 is transversally disposed on the upper face 406 of the dielectric housing 40 and across the conductive terminals 42 and the terminal slots 400, and particularly, the protruding embedded portion 426 is embedded against the fixing strip 44 so that the conductive terminals 12 are firmly retained on the upper face 406 of the dielectric housing 40. In this preferable embodiment, the fixing strip 44 not only secures the conductive terminals 42 but also supports the upper shell 46. The plurality of wires 49 respectively connect with the base portion 424 of the conductive terminals 42, the upper shell 46 is assembled on the dielectric housing 40 above the fixing strip 44, the lower shell 48 is assembled on the dielectric housing 40 opposite to the upper shell 46 and therefore is located below the terminal slots 400, conductive terminals 42 and the wires 49.

In this preferable embodiment, the rear part of the dielectric housing 40 is provided with a plurality of first ribs 401 used for positioning the wires 49 to be in alignment with the corresponding base portion 424 of the conductive terminals 42. One end of the wires 42 is then soldered to the corresponding base portion 424. Furthermore, the front part of the dielectric housing 40 is provided with a plurality of second ribs 403 and third ribs 405, the third ribs 405 are capable of supporting the upper shell 46 and are located in parallel with the second ribs 403, wherein a slit 402 is formed between the second ribs 403 and the third ribs 405. The fixing strip 44 is transversally disposed on the conductive terminals 42 and the terminal slots 400 between the front part and the rear part of the dielectric housing 40 by thermocompression processing or ultrasonic vibration processing. In this preferable embodiment, the fixing strip 44 is just accommodated and positioned in the slit 402 precisely. In addition, the fixing strip 44 further has a plurality of grooves 442 thereon with respect to the embedded portions 426 of the conductive terminals 42, the embedded portions 426 being embedded in the corresponding grooves 442 so as to ensure the conductive terminals 42 are securely retained in the dielectric housing 40 and to prevent the conductive terminals 42 from deforming upwards by a tensile force.

A grounding bar 47 is disposed on the wires 49 and make the wires 49 arranged together. The wires 49 are being grounded with the grounding bar 47. The rear part of the dielectric housing 40 defines a receiving space 404 where the grounding bar 47 is received in. The wires 49 in this embodiment are mini coaxial cables. The upper shell 46 is provided with at least a biasing sheet 462 extending to contact the grounding bar 47, thereby the electrical connector 4 of the present invention is free of electromagnetic wave due to the metal upper shell 46 shields the electromagnetic wave, and is grounded by the grounding bar 47.

Figure 15:
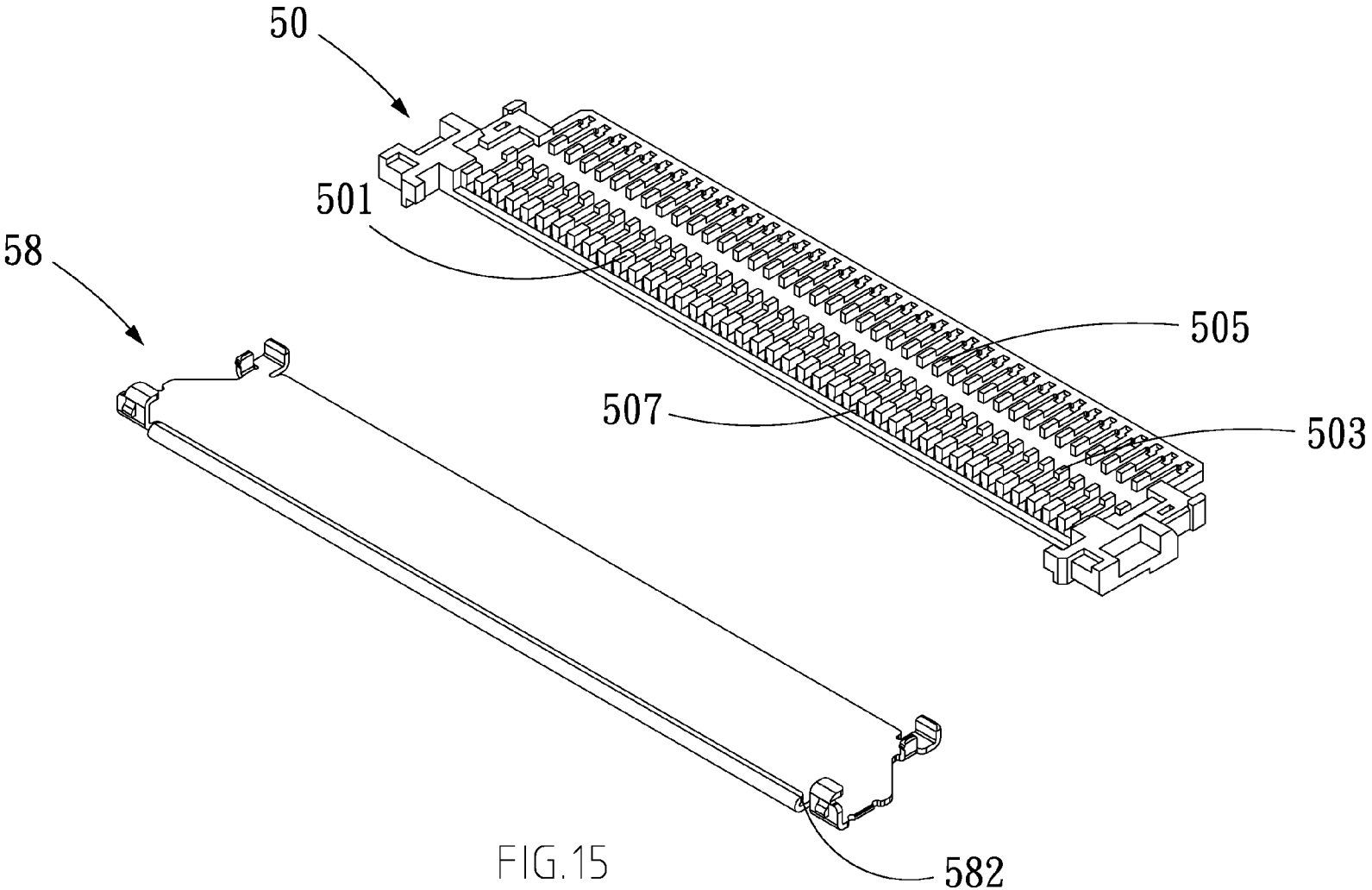
FIG. 15 is a schematic perspective view showing an alternative dielectric housing and a lower shell of the present invention.
Figure 16:
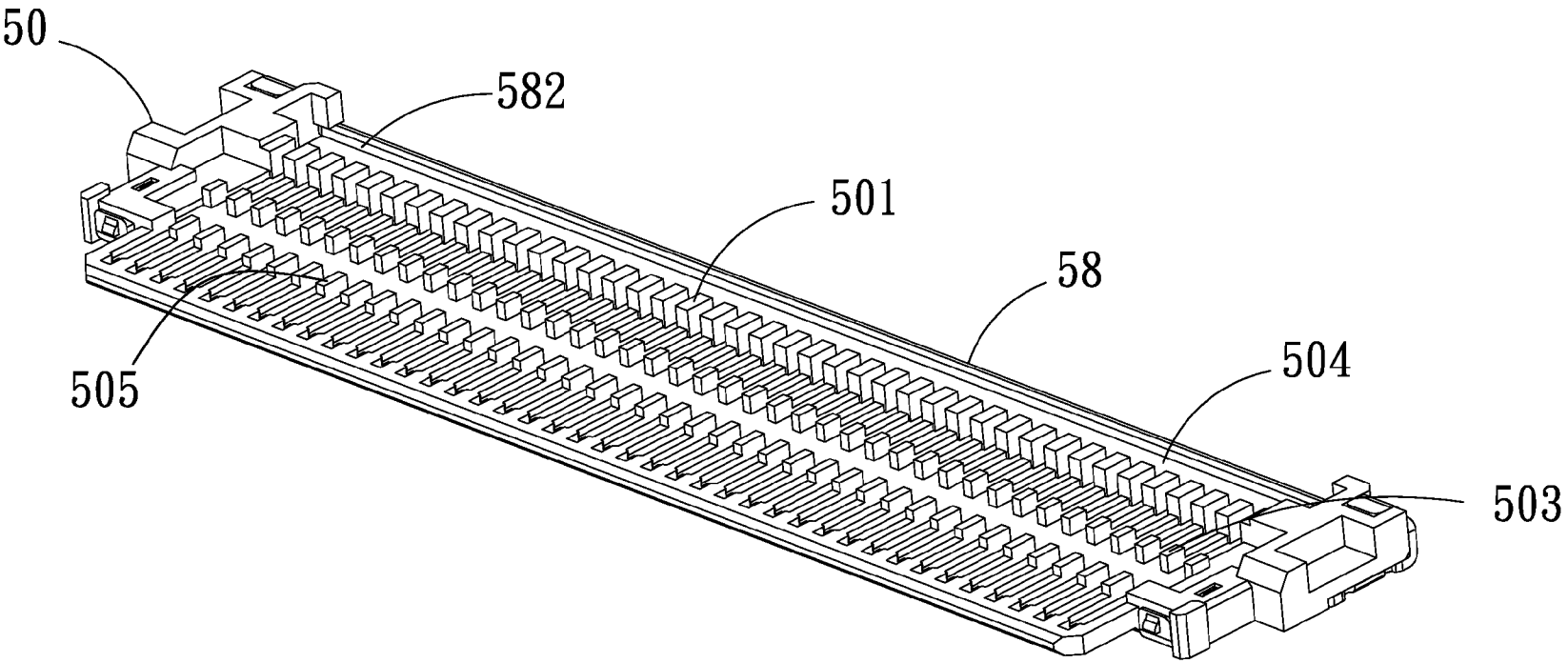
FIG. 16 is a perspective assembly view of FIG. 15.

Alternatively, as shown in FIGS. 15 and 16, the dielectric housing 40 and the lower shell 48 can be replaced by the other type of a dielectric housing 50 and a lower shell 58. The dielectric housing 50 has a plurality of first ribs 501, second ribs 503, third ribs 505, and recesses 507 where the engaged portions 428 of the conductive terminals 42 are engaged in, wherein major differences between the dielectric housing 50 of this embodiment and the dielectric housing 40 of the previous embodiment are that a rear part of the dielectric housing 50 and the lower shell 58 cooperatively define a receiving space 504 therebetween, while the receiving space 404 of the previous embodiment is defined only by the rear part of the dielectric housing 40, and the lower shell 58 has a stop wall 582 bending and extending from one side thereof. As a result, when the grounding bar 47 is received in the receiving space 504, one side of the grounding bar 47 contacts the stop wall 582 and therefore the grounding bar 47 is further positioned and capable of grounding.

Accordingly, an electrical connector of the present invention is characterized in that each of conductive terminals is provided with an embedded portion and engaged portion, the engaged portion is engaged against a corresponding recess formed on a rear part of a dielectric housing, and the embedded portion is embedded against the fixing strip, thereby the conductive terminals are firmly retained in the dielectric housing. In comparison with conventional electrical connectors, an upper side and a lower side of the conductive terminals of the present invention do not have to be surrounded by the dielectric housing and therefore thickness of the electrical connector is reduced.

It is understood that the invention may be embodied in other forms within the scope of the claims. Thus the present examples and embodiments are to be considered in all respects as illustrative, and not restrictive, of the invention defined by the claims.

What is claimed is:

1. An electrical connector, comprising:

a dielectric housing having an upper face and a lower face opposite to the upper face, the upper face being provided with a plurality of terminal slots and recesses;

a plurality of conductive terminals received in the corresponding terminal slots of the dielectric housing, each of the conductive terminals having a contact portion, a base portion, and an engaged portion, the contact portion arranged at a front part of the dielectric housing, the base portion arranged at a rear part of the dielectric housing, the engaged portion connecting with the base portion and being engaged against the corresponding recess;

a fixing strip being transversally disposed on the upper face of the dielectric housing and across the conductive terminals and the terminal slots for securing the conductive terminals in the terminal slots;

a plurality of wires respectively connecting with the base portions of the conductive terminals; and an upper shell assembled on the dielectric housing above the fixing strip;

wherein the rear part of the dielectric housing is provided with a plurality of first ribs, the front part of the dielectric housing is provided with a plurality of second ribs and third ribs, and a slit is formed between the second ribs and the third ribs for receiving the fixing strip.

2. The electrical connector of claim 1, wherein each of the conductive terminals further comprises an embedded portion located between the contact portion and the base portion, the embedded portion being embedded against the fixing strip.

3. The electrical connector of claim 2, wherein the fixing strip has a plurality of grooves thereon with respect to the embedded portions of the conductive terminals, the embedded portions being embedded in the corresponding grooves.

4. The electrical connector of claim 1, further comprising a lower shell assembled on the dielectric housing opposite to the upper shell and below the terminal slots and conductive terminals.

5. The electrical connector of claim 4, further comprising a grounding bar disposed on the wires, wherein the rear part of the dielectric housing and the lower shell cooperatively define a receiving space therebetween, the grounding bar being received in the receiving space and electrically connecting with the lower shell.

6. The electrical connector of claim 1, further comprising a grounding bar disposed on the wires, wherein the rear part of the dielectric housing defines a receiving space for receiving the grounding bar.

7. The electrical connector of claim 1, wherein the engaged portion is located at a rear end of each of the conductive terminals.

8. The electrical connector of claim 1, wherein the wires are soldered to the corresponding base portion of the conductive terminals.

9. An electrical connector, comprising:

a dielectric housing having an upper face and a lower face opposite to the upper face, the upper face being provided with a plurality of terminal slots and recesses;

a plurality of conductive terminals received in the corresponding terminal slots of the dielectric housing, each of the conductive terminals having a contact portion, a base portion, and an engaged portion, the contact portion arranged at a front part of the dielectric housing, the base portion arranged at a rear part of the dielectric housing, the engaged portion located at a rear end of each of the conductive terminals, and connecting with the base portion and being engaged against the corresponding recess;

a fixing strip being transversally disposed on the upper face of the dielectric housing and across the conductive terminals and the terminal slots for securing the conductive terminals in the terminal slots;

a plurality of wires respectively connecting with the base portions of the conductive terminals; and an upper shell assembled on the dielectric housing above the fixing strip.

10. An electrical connector, comprising:

a dielectric housing having an upper face and a lower face opposite to the upper face, the upper face being provided with a plurality of terminal slots and recesses;

a plurality of conductive terminals received in the corresponding terminal slots of the dielectric housing, each of the conductive terminals having a contact portion, a base portion, and an engaged portion, the contact portion arranged at a front part of the dielectric housing, the base portion arranged at a rear part of the dielectric housing, the engaged portion connecting with the base portion and being engaged against the corresponding recess;

a fixing strip being transversally disposed on the upper face of the dielectric housing and across the conductive terminals and the terminal slots for securing the conductive terminals in the terminal slots;

a plurality of wires respectively connecting with the base portions of the conductive terminals; and an upper shell assembled on the dielectric housing above the fixing strip;

wherein the front part of the dielectric housing is provided with a first plurality of ribs and a second plurality of ribs, and a slit is formed between the first plurality of ribs and the second plurality of ribs for receiving the fixing strip.

* * * * *